US006553736B2

(12) United States Patent
Montanaro et al.

(10) Patent No.: US 6,553,736 B2
(45) Date of Patent: Apr. 29, 2003

(54) INTERLOCKING TRUSS SYSTEM

(76) Inventors: Antonio Montanaro, 29 Celestine Drive, Etobicoke, Ontario (CA), M9R 1X3; Guiseppe Montanaro, 3 East Georges Boulevard, Weston, Ontario (CA), M9R 1X2

( * ) Notice: Subject to any disclaimer, the term of this patent is extended or adjusted under 35 U.S.C. 154(b) by 1 day.

(21) Appl. No.: 09/746,443

(22) Filed: Dec. 26, 2000

(65) Prior Publication Data

US 2002/0078655 A1 Jun. 27, 2002

(51) Int. Cl.[7] ..... E04B 1/18

(52) U.S. Cl. ..... 52/633; 52/93; 52/738; 52/34; 52/693; 52/633; 52/639; 52/737.6; 52/694; 52/646; 52/656.1; 52/643; 189/37

(58) Field of Search ..... 52/693, 694, 729, 52/730, 639, 690, 641, 642, 656.1, 653.1, 93.1, 283

(56) References Cited

U.S. PATENT DOCUMENTS

| | | | | | |
|---|---|---|---|---|---|
| 1,924,881 | A | | 8/1933 | Ragsdale | |
| 2,004,894 | A | * | 6/1935 | Hughes | 189/37 |
| 2,284,898 | A | * | 6/1942 | Hartman | 189/34 |
| 3,152,671 | A | | 10/1964 | Mallory | |
| 3,656,270 | A | * | 4/1972 | Phillips | 52/693 |
| 4,414,787 | A | * | 11/1983 | Kappen | 52/643 |
| 4,435,929 | A | * | 3/1984 | Bussell | 52/93 |
| 4,887,406 | A | * | 12/1989 | Saia | 52/694 |
| 4,982,545 | A | * | 1/1991 | Stromback | 52/639 |
| 5,417,028 | A | * | 5/1995 | Meyer | 52/738 |
| 5,457,927 | A | * | 10/1995 | Pellock et al. | 52/633 |
| 5,463,837 | A | | 11/1995 | Dry | |
| 5,761,873 | A | | 6/1998 | Slater | |
| 5,771,653 | A | * | 6/1998 | Dolati et al. | 52/737.6 |
| 5,865,008 | A | | 2/1999 | Larson | |
| 5,987,842 | A | * | 11/1999 | Klein | 52/656.1 |
| 6,047,513 | A | * | 4/2000 | Gibson | 52/646 |

* cited by examiner

*Primary Examiner*—Carl D. Friedman
*Assistant Examiner*—Steve Varner
(74) *Attorney, Agent, or Firm*—Arne I. Fors

(57) ABSTRACT

There is provided a metal chord member for use in a building system which chord member is formed of two or more interlocked generally U-shaped chord tubes. The chord tubes are interlocked by means of the provision of a plurality of equisized, equispaced, longitudinal ribs formed along the length of the depending side arms of the U-shaped chord tubes defining elongated recesses therebetween, the ribs on one of the chord tubes being adapted to interlock into and mate with the recesses defined between ribs on the adjacent chord tube and vice versa.

6 Claims, 6 Drawing Sheets

INTERLOCKING TRUSS SYSTEM

FIELD OF THE INVENTION

The present invention relates to an interlocking, adaptable, metal truss construction useful for floor joists, roof trusses, roof rafters, wall studs, beams, posts, chords, and lintels and relates to a novel chord member consisting of interlocked two or more chord tubes for use in said truss construction. More specifically, the truss construction finds particular application in metallic light-weight structural framing and modular concrete forming.

DESCRIPTION OF THE RELATED ART

Open-web floor joists and roof rafters having wooden upper and lower wooden chords joined at equispaced intervals by U-shaped metal diagonals are known. The truss construction has the advantage over solid wooden joists and rafters of permitting utilities such as plumbing, electrical wiring and ventilation ductwork to freely pass through open spaces in the trusses, whilst using up to thirty percent less material.

Light-weight structural framing systems comprised of solid metal channel and I-beam studs and top and bottom horizontal tracks and bridging channels joined by sheet metal angle brackets and gussets using sheet metal screws or by tack welds are also known. The webs of the channel and I-beam joists are closed, necessitating the costly drilling or cutting of the webs by skilled workmen to allow utilities to pass through.

E. J. W. Ragsdale, in U.S. Pat. No. 1,924,881 discloses an open trussed girder having hollow chords of generally channel form and three-sided hollow web members secured to the inner sides of said hollow chords portion by means of integral extensions. The integral extensions are bent to fit against the corresponding walls of the hollow chords.

U.S. Pat. No. 3,152,671 issued to A. M. Mallory, Jr. teaches structural truss members having C-shaped angular chord members carrying protruding end attachment plates. One embodiment describes truss members provided with upper and lower spans each span comprising a plurality of segmental chords. The latter are C-shaped in cross section and longitudinally disposed in end to end abutment to form the upper and lower linear spans of the trusses.

In U.S. Pat. No. 5,761,873 issued to J. Slater, there is disclosed a web, beam and frame system for a building structure. The system comprises the load bearing members, i.e. beams, wherein each beam is assembled to include a pair of hollow metal cords of equal outer cross-section, and a metal web shaped to provide a pair of jigs which pre-locate the chords parallel to one another. Each web has a plurality of holes for installation of the fasteners therethrough and into the chords.

In U.S. Pat. No. 5,463,837, D. J. Dry discloses a new and improved metal truss wherein the bottom and top chord members are of a substantially uniform shape and cross-section. A radiussed hemmed edge is provided along both legs of the truss chord to protect workers from injury. One or more stiffening ribs are formed in the side walls of the chord members.

J. L. Larson in U.S. Pat. No. 5,865,008 provides a structural shape for use in frame construction which is illustrative of the state of the art. The chord member utilized in the structural shape defines a generally U-shaped cross-section forming a narrower central section with upper and lower portions being of a greater width. An upper, inwardly extending flanged portion has a distance between the legs of the chord which is greater than the distance between the narrow central section legs, thereby enabling easier installation of webs or struts into the chord members.

In my co-pending application Ser. No. 09/105986, there is described a metal truss for use as floor joists, wall studs, and roof trusses. The metal truss comprises a pair of parallel, spaced-apart, elongate metal chord tubes, and a plurality of diagonal metal members equispaced along said pair of tubes for interconnecting the chord tubes. The diagonal members are arranged in V-shaped pairs with a diagonal member of each pair being attached alternately on opposite sides of the chord tubes using fasteners. The metal truss construction further extends to the inclusion of thermal break pads formed of a heat insulating material which are installed between the diagonal members and the elongated metal chord tubes.

In another co-pending application, Ser. No. 09/320,631, a specific embodiment of the invention provides a metal roof truss comprising a pair of parallel, spaced apart, generally U-shaped elongate chord members each having a longitudinal axis, a plurality of alternating diagonal bracing members securely fastened by means of fasteners within said chord members at predetermined intervals and angles. The diagonal bracing members define a generally U-shaped section consisting of a central web and depending side arms, each said side arm having an inwardly extending bent or curved lip portion along the distal edges thereof. The elongate chord members are maintained by said diagonal bracing members in a reinforced, fixed, rigid, spatial relationship one to another.

The disclosures of the above-referenced co-pending applications are hereby incorporated by reference.

SUMMARY OF THE INVENTION

It is an objective of the present invention to provide a novel, chord member comprising at least two interlocked chord tubes, said chord member being used in the construction of novel metal truss assemblies, particularly for floor joists, roof trusses, roof rafters, wall studs, beams, posts, chords and lintels. The chord tubes are elongate, of a generally U-shaped cross-section and are characterized in having depending, crenellated side arms which define a plurality of identical, opposed, generally rectangular, longitudinal, reinforcing ribs defining elongated recesses therebetween extending along the length thereof. The interlocking of adjacent chord tubes to form the chord member is effected by having equisized and equispaced ribs on the depending side arms of one chord tube being adapted to fit into the spaces formed between adjacent equisized and equispaced ribs defined on the depending side arms of adjacent chord tubes. Fasteners located at predetermined intervals along the depending side arms of the interlocked chord tubes further secure adjacent chord tubes one to another.

It is a further objective of the present invention to provide metal truss assemblies utilizing the interlocking chord member of the invention to increase the structural strength thereof. Reinforcement and augmentation of the structural strength of the metal truss structure is attained by the expedient of providing the increased number of chord tubes forming the chord member, and the provision of a plurality of reinforcing, or stiffening, ribs on the depending arms of each chord tubes. Additionally, whilst all of the chord members utilized in the metal truss assemblies may not incorporate an interlocked chord member, preferably the non-interlocked chord members, that is to say the chord tubes, are provided with one or more identical, opposed, longitudinal reinforcing ribs along the length of the depending side arms thereof.

It is yet still another objective of the invention to provide novel metal truss structures utilizing chord members formed of the interlocking chord tubes which may be rapidly and cost effectively assembled either at a factory installation or at a construction site, and which may be incorporated into a building system.

In its simplest embodiment, the invention comprises a metal chord member for use in a building system which consists of two or more interlocking chord tubes wherein each chord tube comprises an elongate member having a generally U-shaped cross-section forming a central web and depending side arms, each of said side arms forming a plurality of identical, opposed, outwardly extending, longitudinal, generally rectangular ribs along the length thereof defining elongated recesses therebetween, said ribs being equisized and equispaced and positioned in a predetermined spatial relationship one to another whereby the ribs on one chord tube are adapted to interlock into the elongated recesses defined between adjacent ribs on adjacent chord tubes.

In the broadest embodiment pertaining to a metal truss structure, the invention comprises at least one elongate interlocking, first metal chord member which consists of two or more interlocking chord tubes wherein each chord tube comprises an elongate, member having a generally U-shaped cross-section said chord tube forming a central web and depending side arms, each of said side arms forming a plurality of identical, opposed, outwardly extending, longitudinal, generally rectangular ribs along the length thereof, defining elongated recesses therebetween, said ribs being equisized and equispaced and positioned in a predetermined spatial relationship one to another whereby the ribs on one chord tube are adapted to interlock into the mating recesses defined between adjacent ribs on adjacent chord tubes, and a second, spaced apart chord member, or chord tube, which chord members, or chord tubes, are interconnected by means of bracing members having particularly angled configurations. Preferably, said bracing members would define a generally U-shaped cross-section having inwardly extending curved lips formed along the upper edges of the side walls thereof. Also in this the broadest embodiment, the second chord member would preferably comprise an identical chord member to said first chord member.

The invention further extends to a novel metal truss assembly consisting of a floor joist, a roof truss and wall studs, and wherein said truss assembly incorporates the interlocked chord tubes as a chord member, preferably a chord member utilized in the construction of a floor joist, a roof truss or wall studs. Additionally, at least one elongate stiffening rib extending longitudinally along the length of each of the depending side arms of the generally U-shaped chord tubes is provided on the chord members utilized in the construction of roof truss and wall studs. The most preferred embodiment of the metal truss assembly incorporates a floor joist having upper and lower chord members each consisting of three interlocked chord tubes, a roof truss having upper chord tubes wherein the depending side arms define two identical, longitudinal, generally rectangular reinforcing ribs in predetermined spacial relationship along the length thereof, and a lower chord tube defining one identical, longitudinal, generally rectangular rib, said upper and lower chord tubes being interconnected by means of a pair of opposed, angled diagonal chord members, and the wall studs include chord tubes defining one longitudinal reinforcing rib along the depending side walls thereof, which rib extends along the length of said chord tube.

Broadly stated, the metal truss assembly comprises a roof truss consisting of a pair of parallel, spaced apart, generally U-shaped, elongate chord tubes interconnected by means of a pair of angled, diagonal chord tubes at the outer ends thereof, said chord tubes defining a central web and depending side arms, each of said arms forming at least one identical, opposed, longitudinal, generally rectangular ribs along the length thereof defining elongated recesses therebetween, and a plurality of bracing members alternately positioned between and securely affixed by means of fasteners within said chord members, said bracing members being positioned between said chord tubes in a vertical orientation or a diagonal orientation, said bracing member having a generally U-shaped section, and wherein said elongate chord tubes are maintained by said bracing members in a reinforced, fixed, rigid, spatial relationship one to another; a wall stud consisting of two spaced-apart, parallel, elongate chord tubes each having a U-shaped cross-section with a central web and depending side arms, each of said side arms forming at least one identical, opposed, longitudinal, generally rectangular rib along the length thereof defining elongated recesses therebetween, and a plurality of bracing members alternately positioned between and securely affixed by means of fasteners within said chord tubes, said bracing members being positioned between said chord tubes in a diagonal orientation said bracing member having a generally U-shaped sections, and wherein said elongate chord tubes are maintained by said bracing members in a reinforced, fixed, rigid, spatial relationship one to another; and a floor joist consisting of two spaced-apart, parallel, elongate, chord members, at least one of said chord members comprising two or more interlocked chord tubes, said chord tubes defining a central web and depending side arms, each of said arms forming a plurality of identical, opposed, generally rectangular ribs longitudinally along the length thereof defining elongated recesses therebetween, and a plurality of bracing members alternately positioned between and securely affixed by means of fasteners within said chord members, said bracing members being positioned between said chord members in a diagonal orientation, said bracing member having a generally U-shaped section and wherein said elongate chord members are maintained by said bracing members in a reinforced, fixed, rigid, spatial relationship one to another.

Preferably, the bracing members utilized in the floor joist, roof truss and wall studs form along the length of both side walls of said generally U-shaped section of the bracing members, at the outermost distal portion of said side walls, an inwardly extending curved lip portion.

Preferably, the fasteners are selected from spot welds, clinging, self-tapping screws, rivets, and nut and bolt assemblies. The most preferred fastener would be a spot weld.

Advantageously, in providing, in combination, the interlocked chord members, together with bracing members having a generally U-shaped cross-section defining an inwardly extending lip along the distal edge portion of the side walls thereof, not only may the fasteners be easily placed to secure said bracing members within said chord members, thus facilitating ease and thus cost effectiveness of fabrication, but by the provision of the interlocked chord members unexpectedly high mechanical strength and rigidity with resistance to lateral deflection may be obtained.

DESCRIPTION OF THE DRAWINGS

The trusses of the invention and the related building system will now be discussed by way of example, having reference to the accompanying drawings in which.

DESCRIPTION OF THE PREFERRED EMBODIMENT

Figure 1:
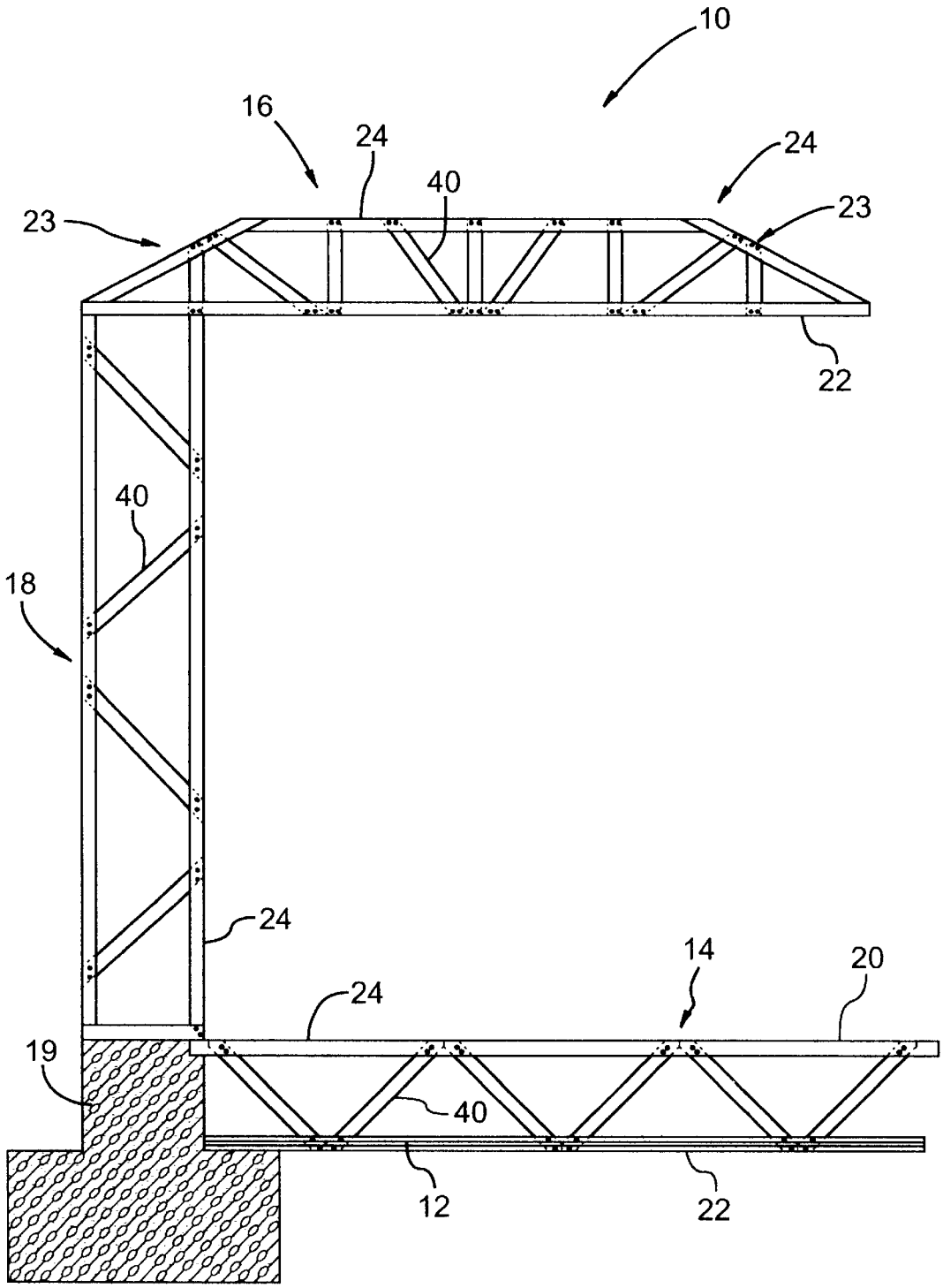
FIG. 1 is an elevational view of the overall building system of the present invention.

Having reference to the accompanying drawings, there is generally depicted in FIG. 1 an overall building system 10 utilizing the interlocked chord member 12 of the present invention. More specifically, the building system comprises floor joists 14, roof trusses 16 and wall studs 18, which may be assembled at a factory or transported to a building site for assembly on foundation 19. The invention further extends to beams, posts and lintels.

Figure 2:
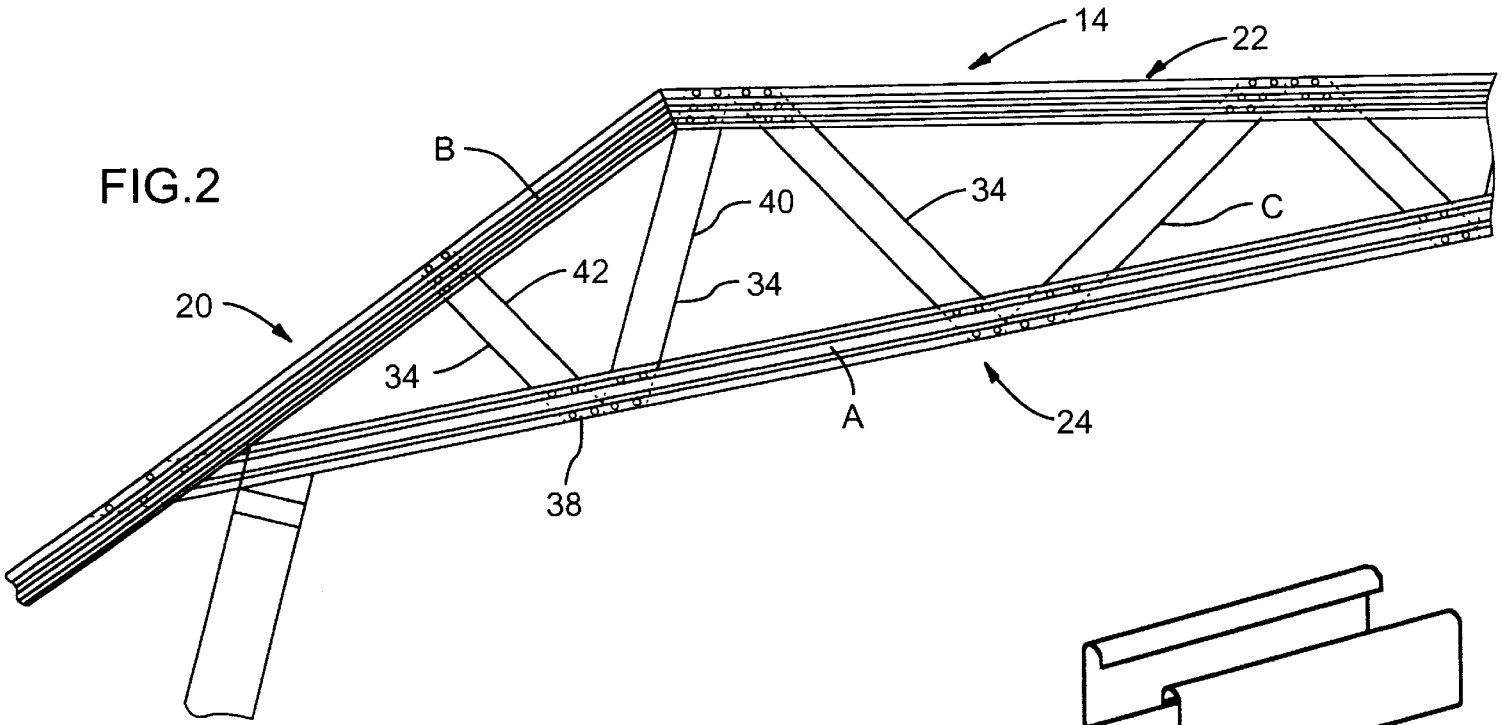
FIG. 2 is a side elevational view of the floor joist of the building system of FIG. 1.
Figure 2C:
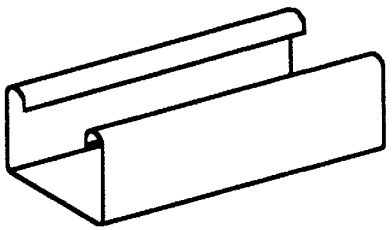
Figure 2B:
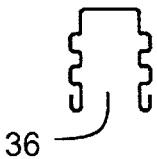
Figure 2A:
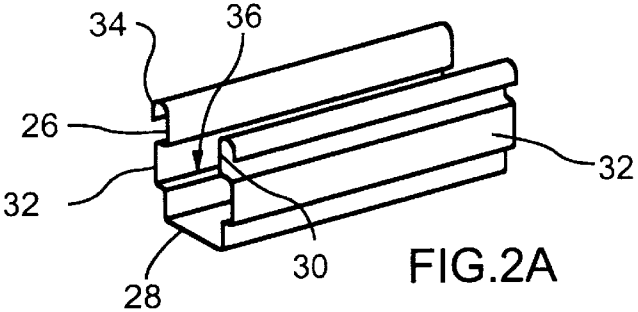

As typified in FIG. 2, the metal floor joist 14 consists of upper and lower chord members 20, 22, respectively which chord members consist of the individual interlocked chord tubes 24 of the instant invention. The interlocked units are referred to as chord members and the single tubes as chord tubes herein.

Figure 3:
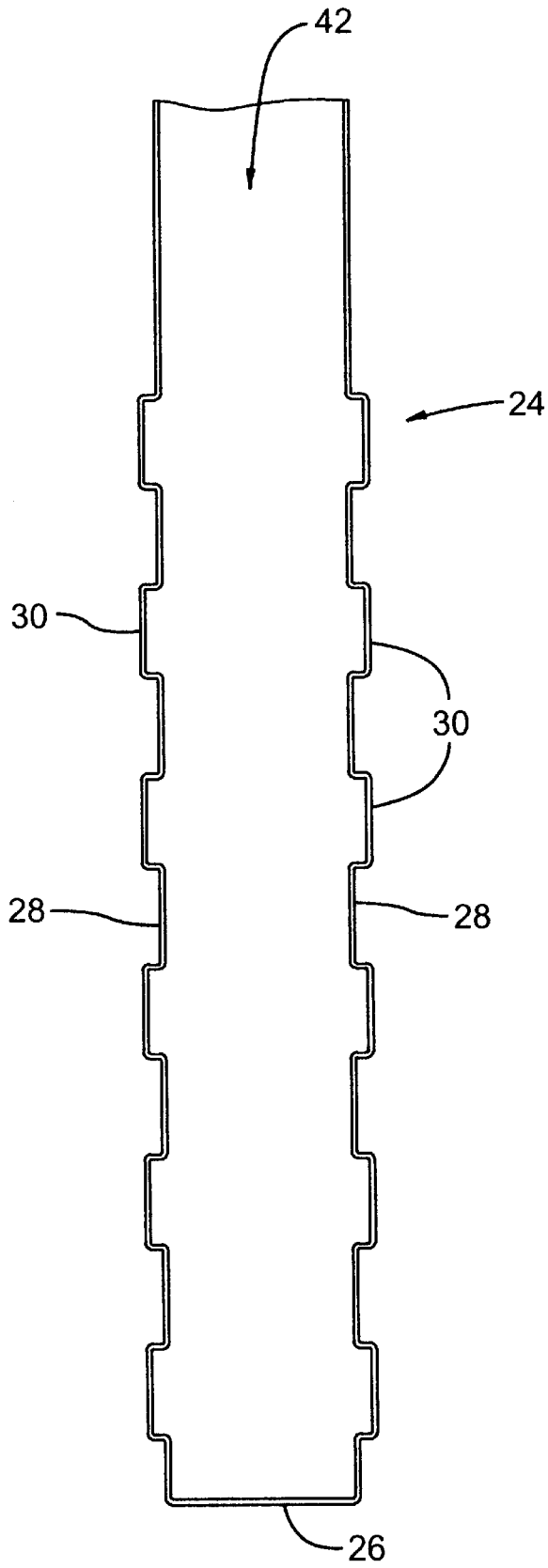
FIG. 3 is a side sectional view showing a single chord tube of the chord members of the floor joist of FIG. 2.
Figure 4:
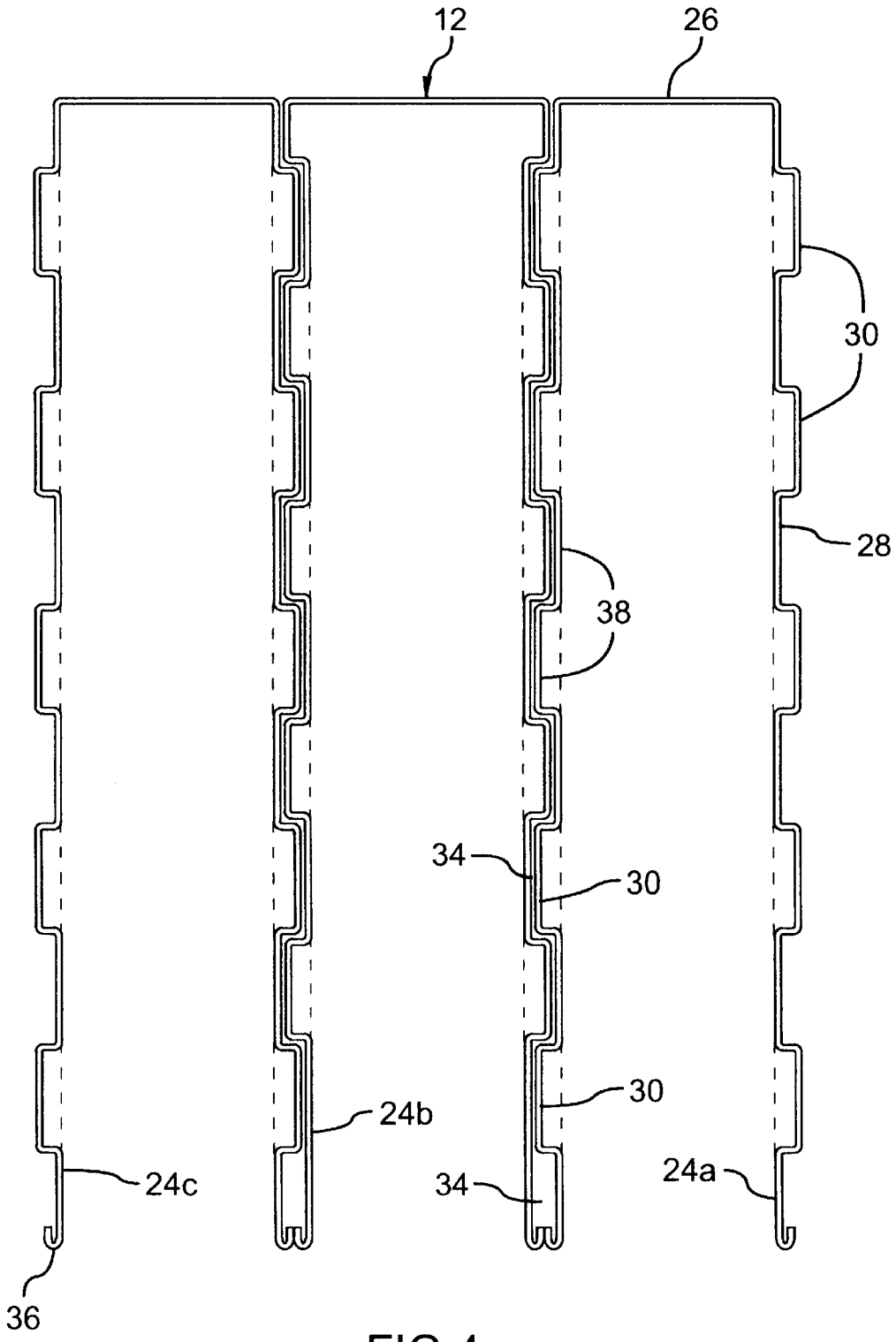
FIG. 4 is a side sectional view showing the lower chord member of the floor joist of FIG. 2 having three single chord tubes interlocked.

More specifically, the chord tubes 24 consist of formed, rolled or extruded metal having, with particular reference to FIGS. 3 and 4, a generally U-shaped, open-ended cross-section defining a central web 26 and depending crenellated side arms 28. The chord tubes 24 are provided with a plurality of opposed, identical, generally rectangular, longitudinal, elongate ribs 30 extending outwardly along the length of the depending crenellated side arms 28 and being integral therewith. The ribs 30 are equisized and equispaced whereby the ribs 30 on a first chord tube 24*a* are adapted to interlock within the spaces or elongated recesses 34 defined on an adjacent chord tube 24*b* between the ribs thereof and vice versa and similarly interlock with a third chord tube 24*c*. Preferably the chord tubes 24 may further define an outwardly extending bent or curved lip portion 36 along the distal edges of said depending crenellated side arms 28.

A plurality of mechanical fasteners 38 are utilized to further secure the interlocked chord tubes 24 one to another. Preferably, the fasteners 38 are selected from spot welds, mechanical clinching, self-tapping screws, rivets, or nut and bolt assemblies.

The chord members 20, 22, are interconnected, reinforced and secured in a predetermined spacial relationship by means of diagonal bracing members 40 to be described hereinafter, positioned within the chord tube channel 42 and affixed therein by a second set of fasteners 44.

The roof truss 16, as typified in FIGS. 5, 5*a*, 5*b* and 5*c*, consists of upper and lower chord members 20, 22 respectively interconnected by means of a pair of angled, diagonal chord members 23 at the outer ends thereof. More specifically, the chord members 20, 22 consist of formed, rolled or extruded metal having a generally U-shaped, open-ended cross-section defining a central web 26 and depending side arms 28 as has described about with respect to FIGS. 3 and 4. Each chord member 20, 22, 23 consists of single chord tubes 24. The upper chord members 20, i.e. chord tube 24*a*, define on each of the depending side arms 28 two identical, opposed, longitudinal, generally rectangular ribs 30*a* along the length thereof. The lower chord member 22 formed of a chord tube 24*b* defines on each of the side arms 28 a single, opposed, longitudinal, generally rectangular rib 30*b* along the length thereof. The angled chord member 23 does not define ribs on the side arms 28 thereof but in common with tubes 24*a* and 24*b* forms an outwardly extending bent or curved lip portion 36 along the distal edges of said depending side arms 28. The roof truss 16 shown herein pertains to that utilized in a flat roof construction but could equally be extended to the conventional triangular configuration.

Figure 5:
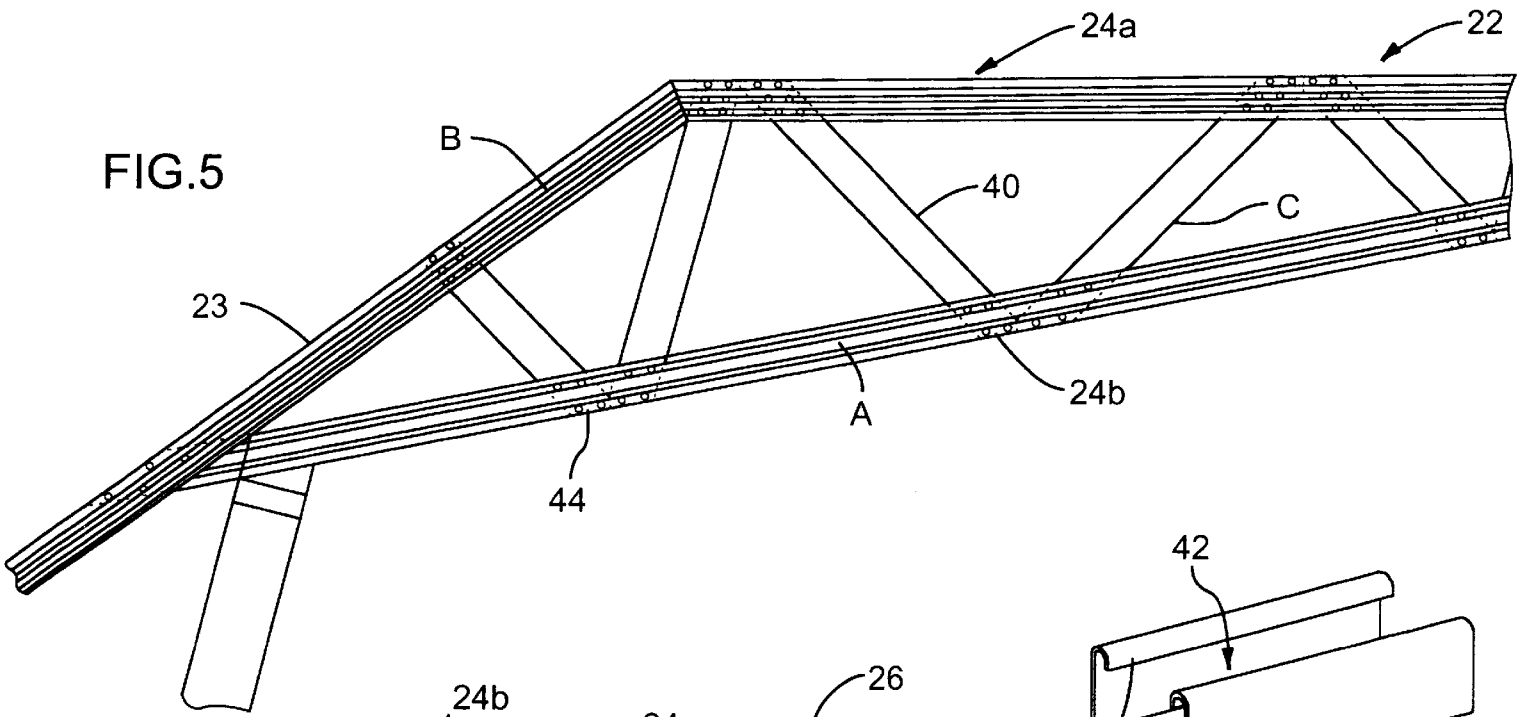
FIG. 5 is an enlarged, perspective view of a metal roof truss as used in the building system of FIG. 1.
Figure 5C:
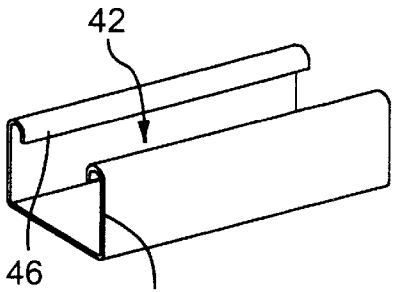
FIG. 5*c* is a side sectional view of a diagonal bracing member of the building system of FIG. 1 taken through the line C—C.
Figure 5B:
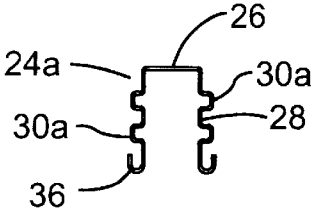
FIG. 5*b* is a side sectional view of an upper chord tube of the metal roof truss of FIG. 5 taken through the line B—B.
Figure 5A:
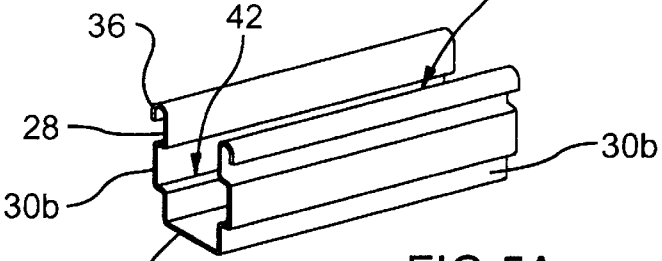
FIG. 5*a* is a side sectional view of the lower chord member of the metal roof truss of FIG. 5 taken through the line A—A.

The chord members 20, 22, 23, of the roof truss 16 are similarly interconnected, reinforced and secured in a predetermined spacial relationship by means of diagonal bracing members 40 as depicted in FIG. 5*c*, positioned within the chord tube channel 42 and affixed therein by fasteners 44. Preferably, the U-shaped, diagonal bracing members 40 are provided with inwardly extending bent or curved lips 46 along the distal edges of said bracing member side walls 45.

Figure 6:
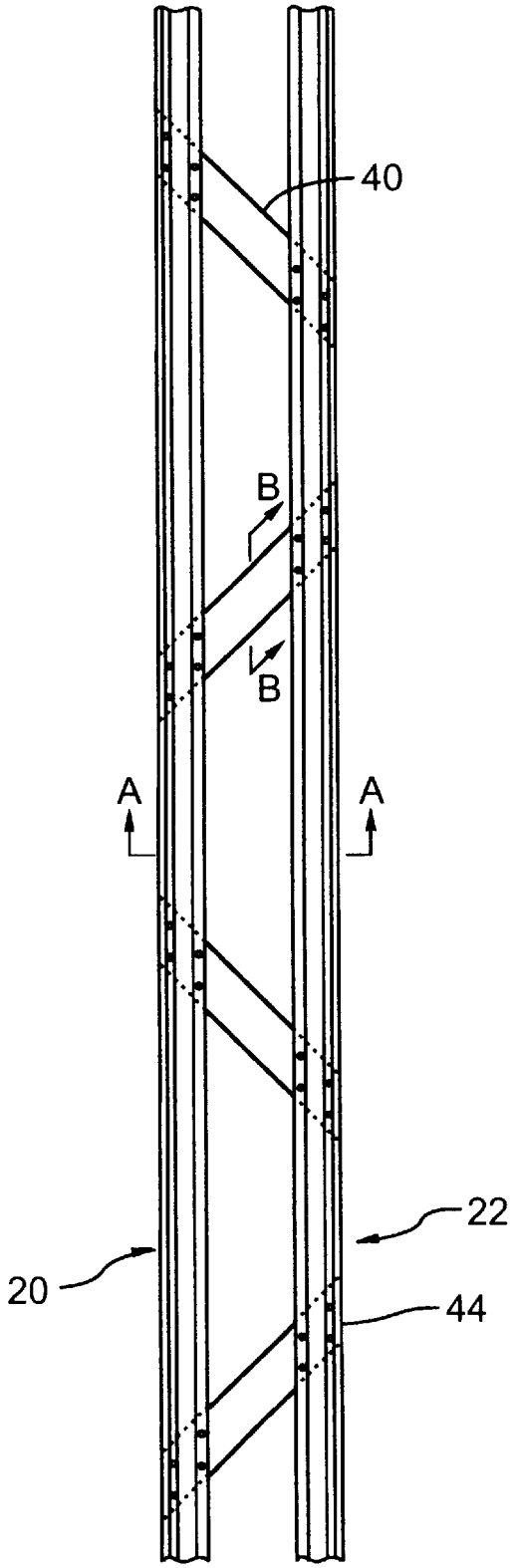
FIG. 6 is a side elevational view of a wall stud as used in the building system of FIG. 1.
Figure 6A:
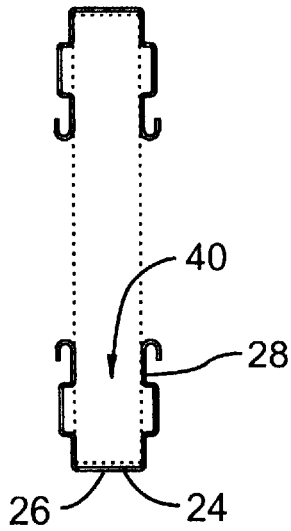
FIG. 6*a* is a side sectional view of the wall stud chord tube of FIG. 6 taken through the line A—A.
Figure 6B:
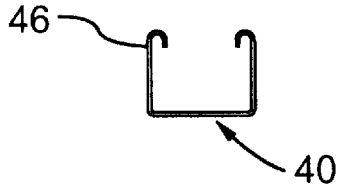
FIG. 6*b* is a side sectional view of the diagonal bracing member of the wall stud of FIG. 6 taken through the line B—B.

As exemplified in FIG. 6, the wall stud 18 consists of formed, rolled or extruded parallel, metal chord members 20,22, comprising single chord tubes 24 having the open-ended ribbed configuration of the chord tubes 24*b* described supra, and detailed in FIG. 6*a*. The chord tubes 24 form single, opposed, longitudinal, generally rectangular ribs 30 on each side of the depending side arms 28 together with curved lips 36 extending outwardly along the distal edges of said side arms 28. The chord members 20, 22 are interconnected by means of diagonal bracing members 40 positioned within the chord channels 42 and secured therein by means of fasteners 44. Preferably, the U-shaped diagonal bracing members 40 are provided with inwardly extending bent or curved lips 46 along the distal edges of said bracing member side walls 45. It is to be noted that for the wall studs 18 it is not a requirement that the diametrically opposed diagonal bracing members 40 abut one another within the chord channels 42 because the requisite codes for mechanical strength, torsional rigidity and deflection are less than for roof trusses and floor joists.

In my co-pending application, Ser. No. 09/320,631, a preferred bracing member wherein the inwardly facing flange lips 46 are reversely bevelled at opposite ends to define parallel bevelled end surfaces at a predetermined angle to the long axis of the bracing member 40 substantially equal to the oblique angle defined between the bracing members 40 and the chord tubes 24 is described. Such a bracing member 40 would preferably be utilized in the construction of the trusses of the present invention.

The fasteners 44 may be selected from self-tapping metal screws, rivets, spot welds, nuts and bolts and mechanical clinching. As is evident in the art, should self-tapping screws or nut and bolt assemblies be utilized, suitable holes must be formed in the chord tubes and correspondingly in the bracing members for receiving the fasteners 44.

Typical wall studs 18 are formed of 16 to 20 gauge galvanized steel chord tubes 1⅞" wide and 1⅞" deep are interconnected by 16 to 18 gauge galvanized steel bracing members 4 to 12" long using steel self-tapping screws, or by welds or by a nut and bolt assembly. Floor joist 14, is formed of 1⅞" wide and 1½" deep chord tubes the distance between upper and lower chord members being between 8 to 36". The chord tubes 24 are formed of 16 to 18 gauge metal. Roof trusses 16 may be fabricated of 1⅝" wide chord tubes ranging between 2½" to 7½" deep and formed of 16 to 18 gauge metal. The bracing members are arranged at predetermined intervals along the chord tubes to thereby provide torsional rigidity to the trusses.

The trusses can be assembled in a factory by the use of mechanical connectors or by spot welding through the open side walls, or the trusses can be assembled at the building site by semi-skilled workmen. The interlocked chord members are suitable for use as roof trusses, wall studs, floor joists, posts, beams or lintels in conventional building construction, or for use as beams in combination with floor jacks in modular building construction for supporting concrete forms, but most typically would be employed in the construction of floor joists, roof trusses and beams. The strength and rigidity of the joists with minimal vertical deflection makes the truss members particularly suited for concrete forming.

The open chord and bracing members permit the installation of services such as electrical wiring and plumbing and the open concept facilitates installation of ducting for furnace and air conditioning systems.

It will be understood that modifications can be made in the embodiment of the invention illustrated and described herein without departing from the scope and purview of the invention as defined by the appended claims.

What is claimed is:

1. A metal truss comprising a pair of parallel, spaced apart chord members, each of said chord members comprising two or more side-by-side interlocking metal chord tubes said chord tubes being elongate, having a generally U-shaped cross-section, and forming a central web and depending side arms, each of said side arms forming a plurality of identical, opposed, outwardly extending, longitudinal ribs defining elongated recesses therebetween, said ribs being equisized and equispaced and positioned in a predetermined spatial relationship one to another whereby the ribs on one chord tube mate with and interlock into the recesses defined between adjacent ribs on adjacent chord tubes, a plurality of alternating diagonal bracing members securely fastened by means of fasteners within said chord members at predetermined intervals and angles, said diagonal bracing members having a generally U-shaped section consisting of a central web and depending side walls, said elongate chord members being maintained by said diagonal bracing members in a reinforced, fixed, rigid spatial relationship one to another.

2. The chord member as set forth in claim 1 further comprising fasteners to secure said ribbed side arms on adjacent chord tubes one to another.

3. The chord member as set forth in claim 2 wherein each of said bracing member side walls defines an inwardly extending bent lip portion along the distal edge thereof.

4. A metal truss assembly which comprises a roof truss consisting of:

a pair of parallel, spaced apart, generally U-shaped, elongate chord tubes interconnected by means of a pair of angled, diagonal chord members at the outer ends thereof, said chord tubes defining a central web and depending side arms, each of said arms forming at least one identical, opposed, longitudinal, generally rectangular ribs along the length thereof defining elongated recesses therebetween, and a plurality of bracing members alternately positioned between and securely affixed by means of fasteners within said chord members, said bracing members being positioned between said chord tubes in a vertical orientation or a diagonal orientation, said bracing members having a generally U-shaped section, said elongate chord tubes being maintained by said bracing members in a reinforced, fixed, rigid, spatial relationship one to another;

a wall stud consisting of two spaced-apart, parallel, elongate chord tubes each having a U-shaped cross-section with a central web and depending side arms each of said side arms forming at least one identical, opposed, longitudinal, generally rectangular rib along the length there of, and a plurality of bracing members alternately positioned between and securely affixed by means of fasteners within said chord tubes, said bracing members being positioned between said chord tubes in a diagonal orientation said bracing member having a generally U-shaped section and forming along the length of both side walls thereof at the outermost distal portion of said side walls an inwardly extending curved lip portion, said elongate chord tubes being maintained by said bracing members in a reinforced, fixed, rigid, spatial relationship one to another; and a floor joist consisting of two spaced-apart, parallel, elongate, chord members, each chord member comprising two or more interlocked chord tubes, said chord tubes defining a central web and depending side arms, each of said arms forming a plurality of identical, opposed, generally rectangular ribs longitudinally along the length thereof defining elongated recesses therebetween, and a plurality of bracing members alternately positioned between and securely affixed by means of fasteners within said chord members, said bracing members being positioned between said chord tubes n a diagonal orientation said bracing members having a generally U-shaped section said elongate chord tubes being maintained by said bracing members in a reinforced, fixed, rigid, spatial relationship one to another.

5. The metal truss assembly as set forth in claim 4 wherein said upper chord tubes of said roof truss form two ribs on the side walls thereof, the wall stud chord tubes form one rib on the side walls thereof and the chord member of the floor joist comprises at least three interlocked chord tubes.

6. The metal truss assembly as set forth in claim 4 wherein the longitudinal ribs defined on the side arms of the interlocked chord tubes of the floor joist chord members are equisized and equispaced and positioned in a predetermined spatial relationship one to another whereby the ribs on one chord tube interlock into the recesses defined between adjacent ribs on adjacent chord tubes.

* * * * *